US005760543A

United States Patent [19]

Gmeiner

[11] Patent Number: 5,760,543

[45] Date of Patent: Jun. 2, 1998

[54] ELECTRICAL INCANDESCENT LAMPS HAVING HOOK-SHAPED COIL HOLDER WITH CONSTRICTED OPENING

[75] Inventor: Hermann Gmeiner, Ingolstadt, Germany

[73] Assignee: Patent-Treuhand-Gesellschaft fur elektrische Gluehlampen mbH, Munich, Germany

[21] Appl. No.: 692,791

[22] Filed: Jul. 19, 1996

[30] Foreign Application Priority Data

Jul. 28, 1995 [DE] Germany ..... 195 27 580.2

[51] Int. Cl.[6] ..... H01K 1/50; H01K 1/18

[52] U.S. Cl. ..... 313/578; 313/271; 313/579; 313/277

[58] Field of Search ..... 313/578, 579, 313/271, 277

[56] References Cited

U.S. PATENT DOCUMENTS

| | | | |
|---|---|---|---|
| 2,449,679 | 9/1948 | Van Horn | 313/271 |
| 2,497,566 | 2/1950 | Stone et al. | 313/271 |
| 2,924,735 | 2/1960 | Martin | 313/271 |
| 3,254,257 | 5/1966 | Hoeh | 313/271 |
| 3,725,720 | 4/1973 | Petro et al. | 313/271 |
| 4,812,710 | 3/1989 | Klam et al. | 313/579 |

FOREIGN PATENT DOCUMENTS 1487502 10/1977 United Kingdom .

*Primary Examiner*—Ashok Patel
*Assistant Examiner*—Jay M. Patidar
*Attorney, Agent, or Firm*—Carlo S. Bessone

[57] ABSTRACT

The invention concerns an electrical incandescent lamp with a mount for holding a filament coil (4), whereby the coil is suspended by at least one hook-shaped holder (7) provided with a free end, in which filament coil (4) is suspended. Free end (7*a*) of hook-shaped holder (7) is bent in such a way that it (7*a*) constricts the suspension opening of hook-shaped holder (7). In this way, an unhooking of the coil is avoided when vibrations occur.

3 Claims, 1 Drawing Sheet

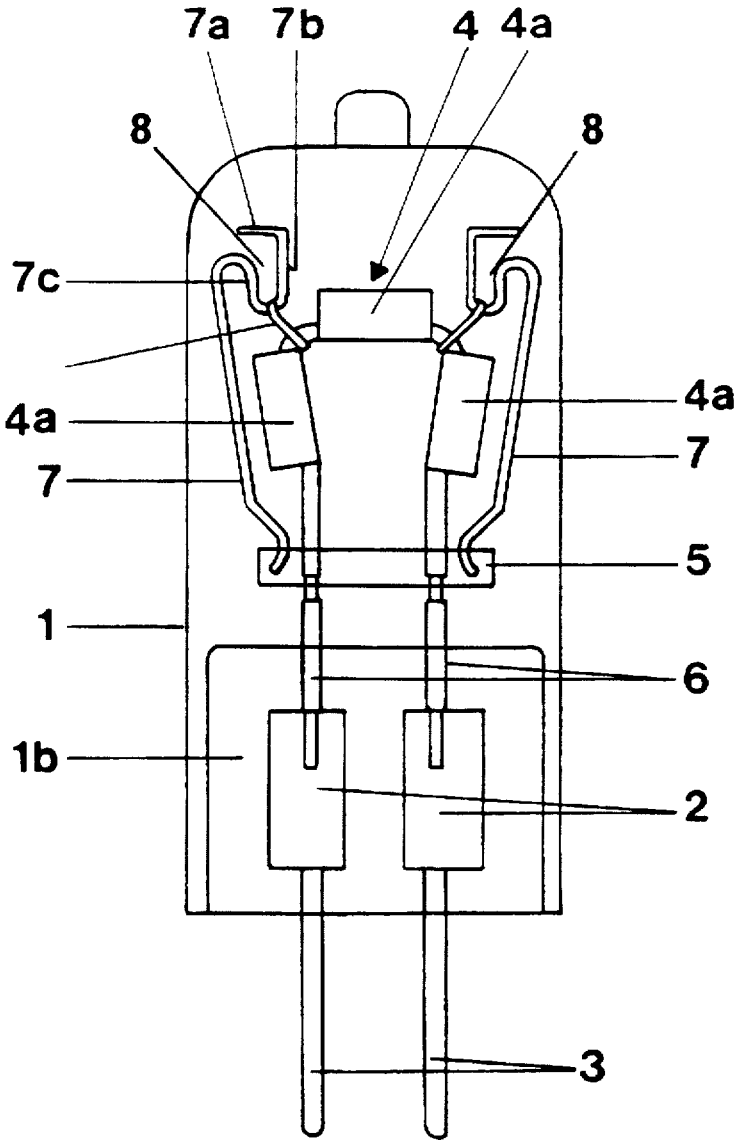
7a
7b
4
4a
8
8
7c
4a
4a
7
7
5
1
6
1b
2
3

ELECTRICAL INCANDESCENT LAMPS HAVING HOOK-SHAPED COIL HOLDER WITH CONSTRICTED OPENING

The invention concerns an electrical incandescent lamp with a mount for holding at least one filament coil. The mount includes at least one hook-shaped holder provided with a free end in which the filament coil is suspended.

Such a lamp is disclosed for example, in the German Utility Model G 74-08.624. The particular lamp concerns a halogen incandescent lamp with an M-shaped filament coil, which is held by means of a mount. The mount has two holders of hook shape attached in a quartz crosspiece and the filament coil is suspended in this holder by its non-illuminating coil sections. A disadvantage of this lamp consists of the fact that the coil holder is insufficiently secure against an unhooking of the incandescent coil upon lamp vibrations.

It is the object of the invention to produce an electrical incandescent lamp with an improved coil holder, which, particularly with incandescent lamps equipped with bridge coils, offers sufficient security against an unhooking of the coil, and which also can be manufactured in a cost-favorable manner.

The solution to the above-named task was first attempted by constricting the suspension opening by bending together the hook-shaped holding segment. In fact, this measure reduced the risk of the unhooking of the coil, but of course, the bending together of the hook-shaped holder sections caused an increased rejection rate during lamp production and thus the lamps were manufactured in a more costly manner that was unacceptable, so that this measure could not be employed appropriately for solving the object of the invention.

For electrical incandescent lamps according to the invention, the mount for holding the filament coil comprises at least a hook-shaped holder provided with a free end in which the filament coil is suspended. The free end of the hook-shaped holder is bent in such a way that it narrows the suspension opening of the hook-shaped holder and thus prevents an unhooking of the filament coil. Advantageously, the at-least one hook-shaped holder is provided with a U-shaped section in which the filament coil is suspended. The bent free end of the hook-shaped holder is formed on a first leg of this U-shaped segment and extends in the direction of the second leg of the U, so that the distance between the bent free end of the holder and the second U-shaped leg is smaller than the distance between the two U-shaped legs. In this way, the suspension opening of the hook-shaped holder is constricted, and the danger of an unhooking of the filament coil is reduced. This coil holder is particularly advantageous for incandescent lamps with bridge coils, which have several light-emitting and non-light-emitting coil segments.

The invention will be explained in more detail on the basis of a preferred example of embodiment in the following.

The figure shows a halogen incandescent lamp driven by mains voltage with a power consumption of approximately 650 W according to a preferred example of embodiment, which is a very schematic representation and is not true to scale. The halogen incandescent lamp possesses a lightbulb 1 crimped on one side. Two molybdenum foils 2 are sealed in a gas-tight manner in pinch base 1*b* of the lamp. Further, two current leads 3 project out from pinch base 1*b* and these are each soldered with one of the molybdenum foils 2. A mount for holding an essentially U-shape bridge coil 4, which possesses three light-emitting coil segments 4*a*, is found inside lightbulb 1. The mount comprises a quartz-glass crosspiece 5, two current-conducting wires 6, and two hook-shaped holders 7. The current-conducting wires 6 are each attached to one end of bridge coil 4 and soldered with one molybdenum foil 2, so that an electrically conductive connection arises between current leads 3 and bridge coil 4. The ends of bridge coil 4 and current-conducting wires 6 are further sealed in quartz-glass crosspiece 5. One end of hook-shaped holder 7 is attached in quartz crosspiece holder 5. The other end of hook-shaped holder 7 has a U-shaped segment, in which bridge coil 4 is suspended by means of two wire loops 8. Wire loops 8 are attached to bridge coil 4 in the region of the two coil segments that do not emit light, and which separate the light-emitting coil segments 4*a* from one another. The two hook-shaped holders 7 each have a bent free end 7*a*, which is bent approximately at a right angle from a first leg 7*b* of the corresponding U-shaped holder segment. The bent free ends 7*a* are each extended in the direction of the second leg 7*c* of the corresponding U-shaped holder segment and thereby constrict the suspension opening of hook-shaped holder 7. The suspension opening without bent end 7*a* is defined by the distance between the two legs 7*b*, 7*c* of the U-shaped holder segment and here amounts to approximately 1.8 mm. The effective suspension opening is constricted to approximately 1 mm by the bent free end 7*a* of hook-shaped holder 7 extending in the direction of second leg 7*c*. This corresponds to the distance between the bent free end 7*a* and the end of second leg 7*c* of the U-shaped holder segment. The length of bent free end 7*a* amounts to approximately 2.5 mm. Hook-shaped holders 7 comprise molybdenum wire and wire loops 8 are made of tungsten. Wire loops 8 have a wire thickness of approximately 0.4 mm.

I claim:

1. An electrical incandescent lamp with a longitudinal axis having a mount for holding at least one incandescent coil (4), whereby the mount has at least one hook-shaped holder (7) provided with a free end, in which the at-least one incandescent coil (4) is suspended, is characterized by the fact that free end (7*a*) of hook-shaped holder (7) is bent in a direction perpendicular to the longitudinal axis of the lamp such that the free end (7*a*) constricts a suspension opening defined by the hook-shaped holder (7).

2. The electrical incandescent lamp according to claim 1, further characterized in that the at-least one hook-shaped holder (7) has a U-shaped segment for holding the incandescent coil (4), the free end (7*a*) of holder (7) is formed on a first leg (7*b*) of this U-shaped segment and extends in the direction of second leg (7*c*) of this U-shaped segment, so that the distance between the free end (7*a*) and the second U-shaped leg (7*c*) is smaller than the distance between the two U-shaped legs (7*b*, 7*c*).

3. The electrical incandescent lamp according to claim 1, further characterized in that the incandescent coil is a bridge coil (4) with several light-emitting coil segments (4*a*), which are separated by non-light-emitting coil segments, and the mount has several hook-shaped holders (7), whereby the bridge coil (4) is suspended in a region of the non-light-emitting coil segments in hook-shaped holder (7).

* * * * *